US010160924B2

(12) United States Patent
Merdrignac et al.

(10) Patent No.: US 10,160,924 B2
(45) Date of Patent: Dec. 25, 2018

(54) PROCESS FOR REFINING A HEAVY HYDROCARBON-CONTAINING FEEDSTOCK IMPLEMENTING A SELECTIVE CASCADE DEASPHALTING

(71) Applicant: IFP Energies nouvelles, Rueil-Malmaison (FR)

(72) Inventors: Isabelle Merdrignac, Chaponnay (FR); Jerome Majcher, Lyons (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 183 days.

(21) Appl. No.: 15/100,723

(22) PCT Filed: Nov. 27, 2014

(86) PCT No.: PCT/EP2014/075857
§ 371 (c)(1),
(2) Date: Jun. 1, 2016

(87) PCT Pub. No.: WO2015/082313
PCT Pub. Date: Jun. 11, 2015

(65) Prior Publication Data

US 2016/0304793 A1 Oct. 20, 2016

(30) Foreign Application Priority Data

Dec. 3, 2013 (FR) ..... 13 62029

(51) Int. Cl.

| | |
|---|---|
| ***C10G 1/00*** | (2006.01) |
| ***C10G 67/04*** | (2006.01) |
| ***C10G 55/06*** | (2006.01) |
| ***C10G 69/00*** | (2006.01) |
| ***C10G 69/04*** | (2006.01) |
| ***C10G 69/14*** | (2006.01) |
| ***C10G 21/00*** | (2006.01) |
| ***C10G 21/02*** | (2006.01) |
| ***C10G 21/14*** | (2006.01) |

(52) U.S. Cl.
CPC ..... *C10G 67/049* (2013.01); *C10G 21/003* (2013.01); *C10G 21/02* (2013.01); *C10G 21/14* (2013.01); *C10G 55/06* (2013.01); *C10G 67/0463* (2013.01); *C10G 69/00* (2013.01); *C10G 69/04* (2013.01); *C10G 69/14* (2013.01); *C10G 2300/202* (2013.01); *C10G 2300/205* (2013.01); *C10G 2300/206* (2013.01); *C10G 2400/02* (2013.01); *C10G 2400/16* (2013.01)

(58) Field of Classification Search
CPC ..... C10G 21/003; C10G 21/02; C10G 21/12; C10G 21/14; C10G 21/28; C10G 53/04; C10G 53/06; C10G 55/06; C10G 67/0463; C10G 67/049; C10G 69/00; C10G 69/04; C10G 69/14; C10G 2300/202; C10G 2300/205; C10G 2300/206; C10G 2400/02; C10G 2400/16
See application file for complete search history.

(56) References Cited

U.S. PATENT DOCUMENTS

| | | | | |
|---|---|---|---|---|
| 2,847,353 A * | 8/1958 | Beavon | C10G 21/00 208/102 |
| 2,925,374 A | 2/1960 | Gwin et al. | |
| 3,278,415 A * | 10/1966 | Doberenz | C10G 67/0463 208/251 H |
| 4,940,529 A | 7/1990 | Beaton et al. | |
| 5,124,025 A * | 6/1992 | Kolstad | B01J 19/00 208/162 |
| 5,258,117 A * | 11/1993 | Kolstad | C10G 11/18 208/221 |
| 2006/0118463 A1 | 6/2006 | Colyar et al. | |

OTHER PUBLICATIONS

International Search Report dated Jan. 29, 2015, issued in corresponding PCT/EP2014/075857, 3 pages.

* cited by examiner

*Primary Examiner* — Prem C Singh
*Assistant Examiner* — Brandi M Doyle
(74) *Attorney, Agent, or Firm* — Millen White Zelano and Branigan, PC; Csaba Henter

(57) ABSTRACT

A process for refining a heavy hydrocarbon feedstock containing a) at least two stages of deasphalting in series to separate at least one fraction of asphalt, at least one fraction of heavy deasphalted oil, and at least one fraction of light deasphalted oil, at least one of the stages of deasphalting by a mixture of at least one polar solvent and at least one apolar solvent, the stages of deasphalting being implemented under the subcritical conditions of the mixture of solvents, b) a stage of hydrotreatment of at least a part of the fraction of heavy deasphalted oil, in the presence of hydrogen, c) a stage of catalytic cracking of at least a part of the fraction of light deasphalted oil, alone or in a mixture with at least a part of the effluent originating from stage b).

20 Claims, No Drawings

PROCESS FOR REFINING A HEAVY HYDROCARBON-CONTAINING FEEDSTOCK IMPLEMENTING A SELECTIVE CASCADE DEASPHALTING

FIELD OF THE INVENTION

The present invention relates to a novel process for refining a heavy hydrocarbon feedstock, in particular originating from atmospheric distillation or vacuum distillation of crude oil.

PRIOR ART

Several upcycling schemes for these feedstocks are possible in a refinery depending on the sought products, the nature of the treated crude oil, economic constraints, etc. In these schemes, the use of a catalytic hydrotreatment makes it possible, by bringing a hydrocarbon-containing feedstock into contact with a catalyst and in the presence of hydrogen, to substantially reduce the content of asphaltenes, metals, sulphur and other impurities contained therein, while improving the ratio of hydrogen to carbon (H/C) and converting it in part more or less to lighter cuts.

Of the different types of hydrotreatment, the fixed-bed hydrotreatment of residues (commonly called "Resid Desulphurization Unit" or RDS) is a widespread process in industry. In such a process, the feedstock, mixed with the hydrogen, flows through several fixed-bed reactors arranged in series and containing the catalysts, the first reactor or reactors being used to carry out there mainly the hydrodemetallization of the feedstock (stage called HDM) as well as a part of the hydrodesulphurization (stage called HDS), the last reactor or reactors being used to carry out there the deep refining of the feedstock, and in particular the hydrodesulphurization. Typically, the total pressure is comprised between 10 and 20 MPa and the temperatures are comprised between 340 and 420° C.

Fixed-bed hydrotreatment processes result in high refining performance from a feedstock containing up to 4% by weight, or even 5% by weight, of sulphur and up to 150 to 250 ppm of metals, in particular nickel and vanadium: for example, this process makes it possible to produce, very predominantly, a heavy cut (370° C.+) with less than 0.5% by weight of sulphur and containing less than 20 ppm of metals. This cut obtained in this way can be used as a basis for the production of high-quality fuel oils, in particular when a low sulphur content is required, or a high-quality feedstock for other units such as the catalytic cracking unit. Linking a fixed-bed residue hydrotreatment unit (RDS unit) with a residue fluidized-bed catalytic cracking (RFCC unit) with a view to maximizing the production of gasolines and/or light olefins, in particular propylene, is particularly in demand as the low metals content and low Conradson carbon residue (CCR) of the cut leaving the RDS unit allows optimized utilization of the RFCC unit, in particular in terms of operating costs of the unit. The Conradson carbon content is defined by the standard ASTM D 482 and, for a person skilled in the art, represents a well-known evaluation of the quantity of carbon residues produced after combustion under standard temperature and pressure conditions.

However, RDS units have at least two major drawbacks: on the one hand, the residence times for achieving the specifications required for the effluents are very long (typically 3 to 7 hours), which makes units with large dimensions necessary. On the other hand, the cycle times (time at the end of which the performance of the unit can no longer be maintained because the catalysts are deactivated and/or clogged) are relatively short compared with processes of hydrotreating lighter cuts. This means that the unit has to stop and all or some of the used catalysts are replaced with new catalysts. Reducing the size of the RDS units as well as increasing the cycle times are therefore an important issue in industry.

One of the solutions known in the state of the art consists of producing a linking of a conventional deasphalting unit (called a conventional or standard SDA in the rest of the text) and an RDS unit. The principle of deasphalting is based on separation by precipitation of a petroleum residue into two phases: i) a phase referred to as "deasphalted oil", also called "oil matrix" or "oil phase" or DAO (deasphalted oil); and ii) a phase referred to as "asphalt" or sometimes "pitch", containing, among other things, refractory molecular structures that cause problems at later stages of the refining process. In fact, asphalt, because of its mediocre quality, is a product detrimental to refining schemes, in particular in respect of the performance of the catalysts of the RDS unit, that should be minimized.

The solutions proposed in the prior art, in particular in patent application US 2004/0069685A1 and U.S. Pat. No. 4,305,812 and U.S. Pat. No. 4,455,216, are all based on a conventional deasphalting which, because of its principle, is subject to limitations in terms of yield and flexibility compared with the upcycling intended for petroleum residues. The use of solvents or a mixture of solvents of the paraffinic type in conventional deasphalting is subject, in particular, to a limitation of the deasphalted oil DAO yield, which increases with the molecular weight of the solvent (up to the C6/C7 solvent) then levels out at a threshold specific to each feedstock and each solvent.

In his research, the applicant has developed an improved process for refining a heavy hydrocarbon feedstock making it possible to overcome the above-described drawbacks and comprising:

a) at least two stages of deasphalting in series carried out on said feedstock which make it possible to separate at least one fraction of asphalt, at least one fraction of heavy deasphalted oil, referred to as heavy DAO, and at least one fraction of light deasphalted oil, referred to as light DAO, at least one of said stages of deasphalting being carried out using a mixture of at least one polar solvent and at least one apolar solvent, the proportions of said polar solvent and said apolar solvent in the solvent mixture being adjusted according to the properties of the treated feedstock and according to the desired asphalt yield and/or the desired quality of the deasphalted oil, said stages of deasphalting being implemented under the subcritical conditions of the mixture of solvents used, b) a stage of hydrotreatment of at least a part of the fraction of heavy deasphalted oil, referred to as heavy DAO, in the presence of hydrogen in at least one fixed-bed reactor containing at least one hydrodemetallization catalyst under conditions that make it possible to obtain an effluent containing a reduced content of metals and Conradson carbon, c) a stage of catalytic cracking of at least a part of the fraction of light deasphalted oil, referred to as light DAO, alone or in a mixture with at least a part of the effluent originating from stage b), in at least one fluidized-bed reactor under conditions that make it possible to produce a gaseous fraction, a gasoline fraction, an LCO fraction, an HCO fraction and slurry.

A subject of the process according to the invention is to make a greater flexibility possible in the treatment of feedstocks while accessing a range of selectivity of separation not available up to now with conventional deasphalting.

Another subject of the process according to the invention is to be capable of finer adjustments of the properties of the fractions which can be upcycled of the feedstock sent to the RDS units so as to increase the reduction in size of the RDS units.

DETAILED DESCRIPTION OF THE INVENTION

The present invention relates to an improved process for refining a heavy hydrocarbon feedstock comprising:

a) at least two stages of deasphalting in series carried out on said feedstock which make it possible to separate at least one fraction of asphalt, at least one fraction of heavy deasphalted oil, referred to as heavy DAO, and at least one fraction of light deasphalted oil, referred to as light DAO, at least one of said stages of deasphalting being carried out using a mixture of at least one polar solvent and at least one apolar solvent, the proportions of said polar solvent and said apolar solvent in the solvent mixture being adjusted according to the properties of the treated feedstock and according to the desired asphalt yield and/or the desired quality of the deasphalted oil, said stages of deasphalting being implemented under the subcritical conditions of the solvent mixture used, b) a stage of hydrotreatment of at least a part of the fraction of heavy deasphalted oil, referred to as heavy DAO, in the presence of hydrogen in at least one fixed-bed reactor containing at least one hydrodemetallization catalyst under conditions that make it possible to obtain an effluent containing a reduced content of metals and Conradson carbon, c) a stage of catalytic cracking of at least a part of the fraction of light deasphalted oil, referred to as light DAO, alone or in a mixture with at least a part of the effluent originating from stage b), in at least one fluidized-bed reactor under conditions that make it possible to produce a gaseous fraction, a gasoline fraction, an LCO (light cycle oil) fraction, an HCO (heavy cycle oil) fraction and slurry.

The Feedstock

According to the invention, the feedstock used is selected from feedstocks of petroleum origin of the crude oil type, or a residual fraction originating from crude oils such as an atmospheric residue or a vacuum residue originating from crude, referred to as conventional crude (API degree >20°), heavy crude (API degree comprised between 10 and 20°) or extra heavy crude (API degree <10°).

Said feedstock can also be a residual fraction originating from any pre-treatment or conversion stage, such as for example hydrocracking, hydrotreatment, thermal cracking, hydroconversion of one of these crudes or of one of these atmospheric residues or of one of these vacuum residues. Said feedstock can also be a residual fraction originating from direct coal liquefaction (atmospheric or vacuum residue) with or without hydrogen, with or without catalyst, irrespective of the process used, or also a residual fraction originating from direct liquefaction of ligno-cellulosic biomass alone or in a mixture with coal and/or a fraction of residual petroleum, with or without hydrogen, with or without catalyst, irrespective of the process used.

The boiling point of the feedstock according to the process of the invention is generally greater than 300° C., preferably greater than 400° C., more preferably greater than 450° C.

The feedstock may be of different geographical and geochemical origins (type I, II, IIS or III), and also of different degrees of maturity and biodegradation.

The feedstock according to the process of the invention can have a sulphur content greater than 0.5% m/m (percentage expressed as mass of sulphur relative to the mass of feedstock), preferably greater than 1% m/m, more preferably greater than 2% m/m, even more preferably greater than 4% m/m; a metals content greater than 20 ppm (parts per million expressed as mass of metals relative to the mass of feedstock), preferably greater than 70 ppm, preferably greater than 100 ppm, more preferably greater than 200 ppm; a C7 asphaltenes content greater than 1% m/m (percentage expressed as mass of C7 asphaltenes relative to the mass of feedstock, measured according to the NF T60-115 method), preferably greater than 3% m/m, preferably greater than 8% m/m, more preferably greater than 14% m/m; a Conradson carbon (also called CCR) content greater than 5% m/m (percentage expressed as mass of CCR relative to the mass of feedstock), preferably greater than 7% m/m, preferably greater than 14% m/m, more preferably greater than 20% m/m. Advantageously, the level of C7 asphaltenes is comprised between 1 and 40% and preferably between 2 and 30% by weight.

Stage a) Selective Deasphalting

In the rest of the text and in the preceding text, the expression "solvent mixture according to the invention" is understood to mean a mixture of at least one polar solvent and at least one apolar solvent according to the invention.

The process according to the invention comprises at least two stages of deasphalting in series on the feedstock to be treated, which make it possible to separate at least one fraction of asphalt, at least one fraction of heavy deasphalted oil, referred to as heavy DAO, and at least one fraction of light deasphalted oil, referred to as light DAO, at least one of said stages of deasphalting being carried out using a solvent mixture, said stages of deasphalting being implemented under the subcritical conditions of the solvent mixture used.

The choice of the solvents as well as the proportions of said polar solvent and said apolar solvent in the solvent mixture are adjusted on the one hand according to the properties of the feedstock to be treated and according to the asphalt yield and/or the quality of the deasphalted oils (heavy DAO and light DAO) aimed at in the stages of hydrotreatment (RDS unit) and hydrocracking (RFCC unit).

The deasphalting implemented in the present invention makes it possible, thanks to specific deasphalting conditions, to go further in terms of maintaining the solubilization in the oil matrix of all or some of the polar structures of the heavy resins and the asphaltenes which are the main constituents of the asphalt phase in the case of conventional deasphalting.

The invention thus makes it possible to choose what type of polar structures remain solubilized in the oil matrix. As a result, the selective deasphalting implemented in the invention makes it possible to selectively extract from the feedstock only a part of this asphalt, i.e. the most polar and the most refractory structures in the conversion and refining processes. The asphalt extracted during the deasphalting according to the invention corresponds to the final asphalt composed essentially of polyaromatic and/or heteroatomic molecular structures that are resistant to refining. The result is an improved total yield of deasphalted oil that can be upcycled.

The process according to the invention, thanks to specific deasphalting conditions, makes a greater flexibility possible in the treatment of the feedstocks as a function of their nature but also as a function of the RDS and RFCC units implemented downstream. Moreover, the deasphalting conditions according to the invention make it possible to avoid the limitations in terms of deasphalted oil DAO yield imposed by the use of paraffinic solvents.

The stages of deasphalting of the process according to the invention can be carried out in an extraction column or extractor, or in a mixer-settler.

Preferably, the solvent mixture according to the invention is introduced into an extraction column or a mixer-settler at two different levels. Preferably, the mixture of solvents according to the invention is introduced into an extraction column or a mixer-settler at a single introduction level.

According to the invention, the liquid/liquid extraction of the stages of deasphalting is implemented under subcritical conditions for said mixture of solvents, i.e. at a temperature lower than the critical temperature of the mixture of solvents. When a single solvent, preferably an apolar solvent, is utilized, the deasphalting stage is implemented under subcritical conditions for said solvent, i.e. at a temperature lower than the critical temperature of said solvent. The extraction temperature is advantageously comprised between 50 and 350° C., preferably between 90 and 320° C., more preferably between 100 and 310° C., even more preferably between 120 and 310° C., even more preferably between 150 and 310° C., and the pressure is advantageously comprised between 0.1 and 6 MPa, preferably between 2 and 6 MPa.

The ratio of the volume of the solvent mixture according to the invention (volume of polar solvent+volume of apolar solvent) to the mass of the feedstock is generally comprised between 1/1 and 10/1, preferably between 2/1 to 8/1, expressed in liters per kilograms.

The mixture of solvents used in at least one of the stages of selective deasphalting according to the invention is a mixture of at least one polar solvent and at least one apolar solvent.

Advantageously, the proportion of polar solvent in the mixture of polar solvent and apolar solvent is comprised between 0.1 and 99.9%, preferably between 0.1 and 95%, preferably between 1 and 95%, more preferably between 1 and 90%, even more preferably between 1 and 85%, and very preferably between 1 and 80%.

Advantageously, according to the process of the invention, the boiling point of the polar solvent of the solvent mixture according to the invention is greater than the boiling point of the apolar solvent.

The polar solvent used in the process according to the invention can be selected from pure aromatic or naphthene-aromatic solvents, polar solvents comprising heteroelements, or mixtures thereof. The aromatic solvent is advantageously selected from monoaromatic hydrocarbons, preferably benzene, toluene or xylenes alone or in a mixture; diaromatics or polyaromatics; naphthene-aromatic hydrocarbons such as tetralin or indane;

heteroaromatic aromatic hydrocarbons (oxygen-containing, nitrogen-containing, sulphur-containing) or any other family of compounds having a more polar nature than saturated hydrocarbons such as for example dimethyl sulphoxide (DMSO), dimethylformamide (DMF), tetrahydrofuran (THF). The polar solvent used in the process according to the invention can be an cut rich in aromatics. The cuts rich in aromatics according to the invention can be for example cuts originating from FCC (Fluid Catalytic Cracking) such as heavy gasoline or LCO (light cycle oil) or originating from the petrochemical units of refineries. The cuts derived from coal, biomass or a biomass/coal mixture optionally with a residual petroleum feedstock after thermochemical conversion with or without hydrogen, with or without a catalyst may also be mentioned. Light petroleum cuts of the naphtha type, preferably light petroleum cuts of the straight-run naphtha type, can also be used. Preferably, the polar solvent used is a monoaromatic hydrocarbon, pure or in a mixture with another aromatic hydrocarbon.

The apolar solvent used in the process according to the invention is preferably a solvent made up of saturated hydrocarbon(s) comprising a number of carbon atoms greater than or equal to 2, preferably comprised between 2 and 9. These solvents are used pure or mixed (for example: a mixture of alkanes and/or cycloalkanes or light petroleum cuts of the naphtha type, preferably light petroleum cuts of the straight-run naphtha type).

The choice of the temperature and pressure conditions of the extraction according to the invention combined with the choice of the nature of the solvents and with the choice of the combination of apolar and polar solvents in at least one of the stages of deasphalting make it possible to adjust the performance of the process according to the invention in order to access in particular a range of selectivity previously inaccessible with conventional deasphalting.

In the case of the present invention, the optimization of these key points of adjustment (nature of the solvents, relative proportions of the polar and apolar solvents) makes it possible to separate the feedstock into three fractions: an fraction of asphalt, referred to as final, enriched with impurities and with compounds resistant to upcycling, a fraction of heavy deasphalted oil corresponding to the fraction of heavy deasphalted oil, referred to as heavy DAO, enriched with structures of the least polar, non-refractory resins and asphaltenes which, for their part, are not refractory for the downstream upcycling stages but which generally remain contained in the asphalt phase in the case of conventional deasphalting in one or more stages, and a light deasphalted oil phase corresponding to the fraction of light deasphalted oil, referred to as light DAO, depleted of resins and asphaltenes, and generally of impurities (metals, heteroatoms).

According to the process of the invention, the nature of the solvent and/or the proportion and/or the intrinsic polarity of the polar solvent in the mixture of solvents can be adjusted according to whether it is desired to extract the asphalt during the first stage of deasphalting or during the second stage of deasphalting.

In a first embodiment, the process according to the invention is implemented in a configuration referred to as having decreasing polarity, i.e. the polarity of the solvent mixture used during the first stage of deasphalting is greater than that of the solvent or solvent mixture used during the second stage of deasphalting. This configuration makes it possible to extract, during the first stage of deasphalting, an fraction of asphalt referred to as final and a fraction of complete deasphalted oil referred to as complete DAO; the two fractions referred to as heavy deasphalted oil and light deasphalted oil being extracted from the complete deasphalted oil during the second stage of deasphalting.

In a second embodiment, the process according to the invention is implemented in a configuration referred to as having increasing polarity, i.e. the polarity of the solvent or solvent mixture used during the first stage of deasphalting is less than that of the mixture of solvents used during the second stage of deasphalting. In such a configuration, during the first stage a fraction of light deasphalted oil referred to as light DAO and an effluent comprising an oil phase and an asphalt phase are extracted; said effluent being subjected to a second stage of deasphalting in order to extract an fraction of asphalt and a fraction of heavy deasphalted oil referred to as heavy DAO.

First Embodiment

According to this embodiment, the process according to the invention comprises at least:

a1) a first stage of deasphalting comprising bringing the feedstock into contact with a mixture of at least one polar solvent and at least one apolar solvent, the proportions of said polar solvent and said apolar solvent being adjusted so as to obtain at least one fraction of asphalt and one fraction of complete deasphalted oil referred to as complete DAO; and a2) a second stage of deasphalting comprising bringing the fraction of complete deasphalted oil, referred to as complete DAO, originating from stage a1) into contact with either an apolar solvent or a mixture of at least one polar solvent and at least one apolar solvent, the proportions of said polar solvent and said apolar solvent in the mixture being adjusted so as to obtain at least one fraction of light deasphalted oil, referred to as light DAO, and one fraction of heavy deasphalted oil, referred to as heavy DAO, said stages of deasphalting being implemented under the subcritical conditions of the solvent or the solvent mixture used.

For a given feedstock, the greater the proportion and/or the intrinsic polarity of the polar solvent in the solvent mixture, the higher the yield of deasphalted oil, a part of the polar structures of the feedstock remaining solubilized and/or dispersed in the deasphalted oil DAO phase. Reducing the proportion of polar solvent in the mixture has the effect of increasing the quantity of asphaltenic phase collected.

The first stage of deasphalting thus makes it possible to extract selectively and in an optimal manner suited to each feedstock, an fraction of asphalt, referred to as final, enriched with impurities and with compounds resistant to upcycling, whilst leaving solubilized in the fraction of complete deasphalted oil, referred to as complete DAO, in which all or part of the polar structures of the heavy resins and the least polar asphaltenes, which, for their part, are not resistant with respect to the downstream stages according to the invention. Thus, depending on the apolar/polar solvent proportion, the yield of deasphalted oil can be significantly improved and the yield of asphalt therefore minimized. The asphalt yield can range from 0.1 to 50% and more particularly 0.1 to 25%. This is a point of interest, knowing that the upcycling of the asphalt (detrimental fraction) always constitutes a real limitation to systems including this type of process.

The complete deasphalted oil, referred to as complete DAO, originating from stage a1) extracted with, at least in part, the mixture of solvents according to the invention is preferably subjected to at least one stage of separation in which the complete deasphalted oil, referred to as complete DAO, is separated from the mixture of solvents according to the invention or at least one stage of separation in which the complete deasphalted oil, referred to as complete DAO, is separated from the apolar solvent only.

In a variant of the process, the complete deasphalted oil, referred to as complete DAO, originating from stage a1) extracted at least in part with the mixture of solvents according to the invention is subjected to at least two stages of separation in which the polar and apolar solvents are separated individually in each stage. Thus, for example, in a first stage of separation the apolar solvent is separated from the mixture of complete deasphalted oil, referred to as complete DAO, and polar solvent; and in a second stage of separation the polar solvent is separated from the complete deasphalted oil, referred to as complete DAO.

The stages of separation are carried out under supercritical or subcritical conditions.

At the end of the stage of separation, the complete deasphalted oil, referred to as complete DAO, separated from the mixture of solvents according to the invention is advantageously sent into at least one stripping column before being sent to the second stage of deasphalting.

The mixture of polar and apolar solvents or the individually separated solvents are advantageously recycled. In a variant of the process, only the apolar solvent is recycled into its respective makeup tank. When the recycled solvents are in a mixture, the apolar/polar proportion is verified online and readjusted as needed via makeup tanks individually containing the polar and apolar solvents. When the solvents are separated individually, said solvents are individually recycled into said respective makeup tanks.

The separated fraction of asphalt of the first stage of deasphalting is preferably in the liquid state and is generally at least in part diluted with a portion of the mixture of solvents according to the invention, the quantity of which can range up to 200%, preferably between 30 and 80% of the volume of asphalt drawn off. The asphalt extracted with, at least in part, the mixture of polar and apolar solvents at the end of the stage of extraction can be mixed with at least one fluxing agent so as to be drawn off more easily. The fluxing agent used can be any solvent or mixture of solvents that can solubilize or disperse the asphalt. The fluxing agent can be a polar solvent selected from monoaromatic hydrocarbons, preferably benzene, toluene or xylene; diaromatics or polyaromatics; naphthene-aromatic hydrocarbons such as tetralin or indane; heteroaromatic aromatic hydrocarbons; the polar solvents with a molecular weight corresponding to boiling points comprised for example between 200° C. and 600° C. such as an LCO (light cycle oil from FCC), an HCO (heavy cycle oil from FCC), FCC slurry, HCGO (heavy coker gas oil), or an aromatic extract or an extra-aromatic cut extracted from an oil chain, VGO cuts originating from a conversion of residual fractions and/or coal and/or biomass. The ratio of volume of fluxing agent to the mass of the asphalt is determined so that the mixture can be easily drawn off.

The second stage of deasphalting can be implemented on at least a part, preferably the whole of the complete deasphalted oil referred to as complete DAO originating from the first stage of deasphalting in the presence of a mixture of at least one polar solvent and at least one apolar solvent under subcritical conditions for the mixture of solvents used. The second stage of deasphalting can also be implemented on at least a part, preferably the whole of the complete deasphalted oil referred to as complete DAO originating from the first stage of deasphalting in the presence of an apolar solvent under the subcritical conditions for the solvent used. The polarity of said solvent or mixture of solvents is preferably less than that of the mixture of solvents used in the first stage of deasphalting. This extraction is carried out so as to obtain a precipitated phase corresponding to the fraction of heavy deasphalted oil, referred to as heavy DAO, predominantly comprising the family of the least polar resins and asphaltenes, at least a part of which is sent to the hydrotreatment stage b) (RDS unit) and a phase corresponding to the fraction of light deasphalted oil, referred to as light DAO, predominantly comprising the family of saturated hydrocarbons and the family of aromatic hydrocarbons, at least a part of which is sent to the catalytic cracking stage c) (RFCC unit).

According to the invention, the separation selectivity and therefore the composition of the fractions of deasphalted oil referred to as heavy DAO and light DAO can be modified by adjusting the polarity of the mixture of solvents by means of the nature and the proportion of the apolar/polar solvents in the mixture or the nature of the apolar solvent.

Second Embodiment

In a second embodiment, the process according to the invention comprises at least:

a'1) a first stage of deasphalting comprising bringing the feedstock into contact with either an apolar solvent or a mixture of at least one polar solvent and at least one apolar solvent, the proportions of said polar solvent and said apolar solvent in the mixture being adjusted so as to obtain at least one fraction of light deasphalted oil, referred to as light DAO, and an effluent comprising an oil phase and an asphalt phase; and a'2) a second stage of deasphalting comprising bringing at least a part of the effluent originating from stage a1) into contact with a mixture of at least one polar solvent and at least one apolar solvent, the proportions of said polar solvent and said apolar solvent being adjusted so as to obtain at least one fraction of asphalt and a fraction of heavy deasphalted oil, referred to as heavy DAO, said stages of deasphalting being implemented under the subcritical conditions of the solvent or the mixture of solvents used.

In the present embodiment, the order of extraction of the categories of products is reversed: the polarity of the solvent or the mixture of solvents used in the first stage of deasphalting is lower than that of the mixture of solvents used in the second stage of deasphalting.

The first stage of deasphalting thus makes it possible to selectively extract from the feedstock a fraction of light deasphalted oil, referred to as light DAO, at least a part of which is sent to the catalytic cracking stage c) (RFCC unit), and an effluent comprising an oil phase and an asphalt phase. The first stage of deasphalting can be implemented just as well on an apolar solvent as on a mixture of solvents according to the invention. The nature, the proportion and/or the polarity of the polar solvent in the mixture of solvents is adapted, under the subcritical conditions of the solvent or the mixture of solvents used, so as to extract a fraction of light deasphalted oil predominantly comprising the family of the saturated hydrocarbons and the family of the aromatic hydrocarbons.

The effluent comprising an oil phase and an asphalt phase extracted from the first stage of deasphalting can contain, at least in part, the apolar solvent or the mixture of solvents according to the invention. Advantageously according to the invention, said effluent originating from stage a1) is subjected to at least one stage of separation in which it is separated from the apolar solvent or the mixture of solvents according to the invention or at least one stage of separation in which said effluent is separated only from the apolar solvent contained in the mixture of solvents.

In a variant of the process according to the invention, said effluent originating from stage a'1) can be subjected to at least two successive stages of separation making it possible to separate the solvents individually in each stage of separation (as described in the first embodiment of the invention).

The stages of separation are carried out under supercritical or subcritical conditions.

At the end of the stage of separation, the effluent comprising the oil phase and the asphalt phase separated from the solvent or from the mixture of solvents according to the invention can be sent into at least one stripping column before being sent to the second stage of deasphalting.

The mixture of polar and apolar solvents or the individually separated solvents are advantageously recycled. In a variant of the process, only the apolar solvent is recycled into its respective supplementary tank. When the recycled solvents are mixed, the proportion of the apolar and polar solvents is verified online and readjusted as needed via makeup tanks containing said polar and apolar solvents individually. If the solvents are separated individually, said solvents are individually recycled into said respective makeup tanks.

The second stage of deasphalting is implemented on at least a part, preferably the whole of the effluent comprising an oil phase and an asphalt phase originating from the first stage of deasphalting in the presence of a mixture of at least one polar solvent and at least one apolar solvent under the subcritical conditions for the mixture of solvents used. The polarity of said mixture of solvents is preferably greater than that of the solvent or mixture of solvents used in the first stage of deasphalting. This extraction is carried out so as to selectively extract from the effluent, an fraction of asphalt referred to as final, enriched with impurities and with compounds resistant to upcycling, and a fraction of heavy deasphalted oil in which all or part of the polar structures of the least polar resins and asphaltenes remain solubilized remaining generally contained in the fraction of asphalt in the case of conventional deasphalting. At least a part of said fraction of heavy deasphalted oil, referred to as heavy DAO, is sent to the hydrotreatment stage b) (RDS unit).

The deasphalting process according to the invention has the advantage of allowing a significant improvement in the total yield of light deasphalted oil DAO and heavy DAO over an entire range previously unexplored by conventional deasphalting. For a given feedstock for which the total yield of light deasphalted oil DAO and heavy DAO obtained levels off at 75% (extraction with normal heptane in conventional deasphalting), the deasphalting implemented in the invention makes it possible, under specific conditions, to cover the range 75-99.9% of total yield of light deasphalted oil DAO and heavy DAO by adjustment of the polar solvent and apolar solvent proportion.

The deasphalting process according to the invention, because of its separation selectivity and its flexibility, makes it possible to obtain an fraction of asphalt with a yield of asphalt much lower than that which can be obtained by a conventional deasphalting process in the case of a given feedstock. Said yield of asphalt is advantageously comprised between 1 and 50%, preferably between 1 and 25%, more preferably between 1 and 20%.

Stage b) Hydrotreatment of the Deasphalted Oil Fraction Referred to as Heavy DAO Stage b) of hydrotreatment of at least a part of the fraction of heavy deasphalted oil, referred to as heavy DAO, originating from stage a) is carried out under fixed-bed hydrotreatment conditions. Stage b) is carried out under conditions known to a person skilled in the art.

According to the invention, stage b) is implemented under a pressure comprised between 2 and 35 MPa and at a temperature comprised between 300 and 500° C. and an hourly space velocity comprised between 0.1 and 5 $h^{-1}$; preferably under a pressure comprised between 10 and 20

MPa and at temperatures comprised between 340 and 420° C. and an hourly space velocity comprised between 0.1 and 2 $h^{-1}$.

By hydrotreatment (HDT) is meant in particular hydrodesulphurization (HDS) reactions, hydrodemetallization (HDM) reactions, accompanied by hydrogenation, hydrodeoxygenation, hydrodenitrogenation, hydrodearomatization, hydroisomerization, hydrodealkylation, hydrocracking, hydrodeasphalting and Conradson carbon reduction reactions.

According to a preferred variant, the hydrotreatment stage comprises a first hydrodemetallization stage comprising one or more fixed-bed hydrodemetallization zones optionally preceded by at least two protective hydrotreatment zones, and a second, subsequent hydrodesulphurization stage comprising one or more fixed-bed hydrodesulphurization zones and in which, during the first stage, referred to as hydrodemetallization, the feedstock and the hydrogen are passed, under hydrodemetallization conditions, over a hydrodemetallization catalyst then, during the second, subsequent stage, the effluent from the first stage is passed, under hydrodesulphurization conditions, over a hydrodesulphurization catalyst. This process, known under the name HYVAHL-F™, is described in U.S. Pat. No. 5,417,846.

A person skilled in the art will easily understand that in the hydrodemetallization stage mainly hydrodemetallization reactions, but in parallel also a part of the hydrodesulphurization reactions, are carried out. Similarly, in the hydrodesulphurization stage, mainly hydrodesulphurization reactions, but in parallel also a part of the hydrodemetallization reactions, are carried out.

In a preferred variant according to the invention, stage b) is implemented in one or more fixed-bed hydrodesulphurization zones.

The hydrotreatment catalysts used are preferably known catalysts and are generally granular catalysts comprising, on a support, at least one metal or metal compound having a hydrodehydrogenating function. These catalysts are advantageously catalysts comprising at least one group VIII metal, generally selected from the group formed by nickel and/or cobalt, and/or at least one group VIB metal, preferably molybdenum and/or tungsten. For example a catalyst comprising 0.5 to 10% by weight of nickel and preferably 1 to 5% by weight of nickel (expressed as nickel oxide NiO) and 1 to 30% by weight of molybdenum, preferably 5 to 20% by weight of molybdenum (expressed as molybdenum oxide $MoO_3$) on a mineral support will be used. This support will, for example, be selected from the group formed by alumina, silica, silica-aluminas, magnesia, clays and mixtures of at least two of these minerals. This support advantageously includes other doping compounds, in particular oxides selected from the group formed by boron oxide, zirconium oxide, cerine, titanium oxide, phosphoric anhydride and a mixture of these oxides. Most often an alumina support, and very often an alumina support doped with phosphorus and optionally boron, is used. If the phosphoric anhydride $P_2O_5$ is present, the concentration thereof is less than 10% by weight. If boron trioxide $B_2O_5$ is present, the concentration thereof is less than 10% by weight. The alumina used is usually a γ or η alumina. This catalyst is most often in the form of extrudates. The total group VIB and VIII metal oxides content is often 5 to 40% by weight and generally 7 to 30% by weight and the weight ratio expressed as metal oxide of group VIB metal (or metals) to group VIII metal (or metals) is generally 20 to 1 and most often 10 to 2.

In the case of a hydrotreatment stage including a hydrodemetallization (HDM) stage then a hydrodesulphurization (HDS) stage, specific catalysts adapted to each stage are most often used. Catalysts that can be used in the HDM stage are indicated for example in EP113297, EP113284, U.S. Pat. No. 5,221,656, U.S. Pat. No. 5,827,421, U.S. Pat. No. 7,119,045, U.S. Pat. No. 5,622,616 and U.S. Pat. No. 5,089,463. Preferably HDM catalysts are used in switchable reactors. Catalysts that can be used in the HDS stage are indicated for example in EP113297, EP113284, U.S. Pat. No. 6,589,908, U.S. Pat. No. 4,818,743 or U.S. Pat. No. 6,332,976. A mixed catalyst that is active in HDM and HDS can also be used both for the HDM section and for the HDS section, as described in FR2940143. Prior to the injection of the feedstock, the catalysts used in the process according to the present invention are preferably subjected to a sulphurization treatment (in-situ or ex-situ).

Stage of Separation of the Effluent Originating from Stage b)

Advantageously, according to the invention, the products obtained during stage b) are subjected to a stage of separation from which the following are advantageously recovered:

- a gaseous fraction;
- a gasoline cut having a boiling point comprised between 20 and 150° C.;
- a gas oil cut having a boiling point comprised between 150 and 375° C.;
- a vacuum distillate (vacuum gas oil or VGO) cut;
- a vacuum residue (VR) cut.

Stage c) Catalytic Cracking

Advantageously, the refining process according to the invention comprises a stage of catalytic cracking of at least a part of the fraction of light deasphalted oil, referred to as light DAO, alone or in a mixture with at least a part of the effluent originating from stage b). Advantageously, said stage c) is carried out on a mixture comprising all or part of the fraction of light deasphalted oil, referred to as light DAO, originating from stage a) and at least one vacuum distillate (VGO) cut originating from stage b) and/or a vacuum residue (VR) cut originating from stage b). Advantageously, said VGO and VR cuts originate from a previous stage of separation following stage b).

Stage c) is carried out under conventional catalytic cracking conditions that are well-known to a person skilled in the art, in at least one fluidized-bed reactor so as to produce a gaseous fraction, a gasoline fraction, an LCO (light cycle oil) fraction, an HCO (heavy cycle oil) fraction and slurry.

This stage can be carried out in a conventional manner known to a person skilled in the art under suitable conditions for cracking residue with a view to producing hydrocarbon-containing products with a lower molecular weight. Descriptions of the operation and of catalysts that can be used within the framework of the fluidized-bed cracking in this stage are described for example in the documents U.S. Pat. No. 4,695,370, EP-B-184517, U.S. Pat. No. 4,959,334, EP-B-323297, U.S. Pat. No. 4,965,232, U.S. Pat. No. 5,120,691, U.S. Pat. No. 5,344,554, U.S. Pat. No. 5,449,496, EP-A-485259, U.S. Pat. No. 5,286,690, U.S. Pat. No. 5,324,696 and EP-A-699224, the descriptions of which are considered as incorporated in the present invention.

For example, a brief description of catalytic cracking (the first industrial implementation of which dates back to 1936 (HOUDRY process) or 1942 for the use of fluidized-bed catalyst) will be found for example in ULLMANS ENCYCLOPEDIA OF INDUSTRIAL CHEMISTRY Volume A 18, 1991, pages 61 to 64. A conventional catalyst comprising a matrix, optionally an additive and at least one zeolite is usually used. The quantity of zeolite is variable, but usually approximately 3 to 60% by weight, often approximately 6 to 50% by weight and most often approximately 10 to 45% by weight. The zeolite is usually dispersed in the matrix. The quantity of additive is usually approximately 0 to 30% by weight and often approximately 0 to 20% by weight. The quantity of matrix represents the remainder to 100% by weight. The additive is generally selected from the group formed by oxides of the metals from group IIA of the periodic table of the elements such as for example magnesium oxide or calcium oxide, oxides of the rare earth elements and titanates of group IIA metals. The matrix is most often a silica, an alumina, a silica-alumina, a silica-magnesia, a clay or a mixture of two or more of these products. The zeolite used most commonly is zeolite Y. The cracking is carried out in a substantially vertical reactor either in ascending mode (riser), or in descending mode (dropper).

The choice of the catalyst and of the operating conditions depend on the products required as a function of the feedstock treated, as described for example in the article by M. MARCILLY, pages 990-991, published in the Revue de l'Institut Français du Pétrole November-December 1975 pages 969-1006. Operation is usually at a temperature of approximately 450 to approximately 600° C. and with residence times in the reactor of less than 1 minute, often of approximately 0.1 to approximately 50 seconds.

Stage c) of catalytic cracking is advantageously a stage of fluidized-bed catalytic cracking for example according to the process developed by the applicant called R2R. This stage can be carried out in a conventional manner known to a person skilled in the art under suitable conditions for cracking residue with a view to producing hydrocarbon-containing products with a lower molecular weight. Descriptions of the operation and of catalysts usable in the context of the fluidized-bed cracking in this stage c) are described for example in the patent documents U.S. Pat. No. 4,695,370, EP-B-184517, U.S. Pat. No. 4,959,334, EP-B-323297, U.S. Pat. No. 4,965,232, U.S. Pat. No. 5,120,691, U.S. Pat. No. 5,344,554, U.S. Pat. No. 5,449,496, EP-A-485259, U.S. Pat. No. 5,286,690, U.S. Pat. No. 5,324,696 and EP-A-699224.

The fluidized-bed catalytic cracking reactor can operate with ascending flow or with descending flow. Although this is not a preferred embodiment of the present invention, it can also be envisaged to carry out the catalytic cracking in a moving-bed reactor.

The catalytic cracking catalysts particularly preferred are those that contain at least one zeolite usually in a mixture with a suitable matrix, for example alumina, silica, silica-alumina.

The process according to the invention offers various advantages, namely:

- a minimization of the yield of products that cannot be upcycled (asphalt),
- a reduction of the capacity of the RDS unit while sending to said RDS unit only the molecular species which need to be hydrotreated (fraction of heavy deasphalted oil, referred to as heavy DAO),
- a maximization of the conversion in the catalytic cracking process (RFCC unit) thanks to a flow composed of the fraction of light deasphalted oil, referred to as light DAO, of a high quality (low CCR content) and heavy cuts (VGO+VR) originating from the RDS units, the characteristics of which satisfy the required specifications on entering the RFCC unit,
- a gain in operability, but also an economic gain to the extent that the size of the RDS units is reduced and that, as a result, the quantities of catalysts utilized are reduced.

The following examples illustrate the present invention without, however, limiting its scope.

EXAMPLES

The feedstock selected for the examples is a vacuum residue (initial VR) originating from Athabasca in the North of Canada. Its chemical characteristics are given in Table 1.

Example 1 (Not According to the Invention): Conventional Two-Stage SDA Scheme-RDS-RFCC Example 1 corresponds to a sequence of a conventional SDA unit, an RDS unit and an RFCC unit with an implementation of the conventional two-stage deasphalting, as described in US2008149534. The selected feedstock is subjected to a first deasphalting with the paraffinic solvent normal heptane (nC7), then the deasphalted oil DAO nC7 collected is subjected to a second stage of deasphalting with normal propane (nC3) in order to obtain the fractions of heavy deasphalted oil DAO nC3 and light deasphalted oil DAO nC3. The properties as well as the extraction yields of each of the fractions are given in Table 1.

TABLE 1

Properties of the feedstock and yields and properties of the fractions originating from the conventional two-stage deasphalting carried out with the solvents nC7 for the first stage then nC3 for the second stage.

| | | Initial | | | 2nd stage | |
|---|---|---|---|---|---|---|
| | | Athabasca | 1st stage | | Heavy | Light |
| | | residue 480° C.+ | Asphalt nC7 | DAO nC7 | DAO nC3 | DAO nC3 |
| Extraction Yield (% feedstock) | | 100 | 25 | 75 | 41 | 34 |
| Analyses | | | | | | |
| d4, 15 | — | 1.044 | 1.11 | 1.021 | 1.059 | 0.974 |
| Sulphur | % m/m | 5.72 | 7.90 | 5.00 | 6.22 | 3.50 |
| Nitrogen | ppm | 6200 | 7944 | 5625 | 8927 | 1581 |
| Ni | ppm | 115 | 306 | 52 | 93 | 2 |
| V | ppm | 317 | 823 | 150 | 268 | 5 |
| CCR | % m/m | 20.5 | 45 | 12.4 | 20.5 | 2.5 |

The DAO (nC7) yield is 75% for an asphaltenes C7 content (measured according to the standard NFT60-115) of 14%. It is noted that the yields as well as the qualities of the various DAOs are fixed by the nature of the paraffinic solvent used in each of the two stages.

The heavy DAO nC3 is then sent to RDS hydrotreatment under the operating conditions described in Table 2.

TABLE 2

Operating conditions of the start of the cycle of the RDS unit

| | |
|---|---|
| Catalyst | HF 858 - HT 438 |
| Temperature (° C.) | 370 |
| Pressure (MPa) | 15 |
| HSV ($h^{-1}$) | 0.4 |
| Volumetric distribution of HDM/HDS catalyst (%) | 95/5 |
| $H_2$/feedstock ($Nm^3/m^3$ feedstock) | 1000 |

The catalysts marketed by the company Axens under the following commercial references are used: HF 858 and HT 438:

HF 858: catalyst mainly active in HDM;

HT 438: catalyst mainly active in HDS.

The yields and qualities of the products obtained are described in Table 3.

TABLE 3

Characteristics of the cuts originating from the RDS unit

| Products | Yield (% by weight) | S (% by weight) | Viscosity 100° C. (Cst) | CCR (% by weight) | Ni + V (ppm) |
|---|---|---|---|---|---|
| $NH_3$ | 0.5 | 0 | — | — | — |
| $H_2S$ | 6 | 94.14 | — | — | — |
| C1-C4 | 1 | 0 | — | — | — |
| Gasoline (PI-150) | 1 | 0.012 | — | — | — |
| Gas oil (150-375) | 12 | 0.025 | — | — | — |
| VGO (375-520) | 34 | 0.17 | 10 | 0 | |
| VR (520+) | 47 | 0.97 | 200 | 12 | 20 |

with hydrogen consumed representing 1.50% by weight of the feedstock.

The whole of the light DAO as well as the whole of the VGO (375-520) and 36% of the VR (520+) originating from the RDS unit can be sent to an RFCC unit. In the end, relative to this feedstock, a yield of gasoline of 49% by weight and of LPG (liquefied petroleum gas) laden with propylene of 17% by weight is obtained. In other words, relative to the initial input VR, a yield of gasoline of 21% by weight and of LPG (liquefied petroleum gas) laden with propylene of 7% by weight is obtained.

Example 2 (According to the Invention): Selective Two-Stage SDA Scheme-RDS-RFCC

The feedstock is firstly subjected to the selective two-stage deasphalting according to the invention. The first stage of extraction is carried out with the combination of solvent nC3 (propane)/toluene (36/65; v/v) at a temperature of 130° C., the solvent/feedstock ratio is 5/1 (v/m). This first stage makes it possible to selectively extract from the fraction of asphalt 50% of the asphaltenes C7, and this while minimizing the asphalt yield (10% m/m) (see Table 4). This first stage makes it possible to upcycle the residue at a level of 90% (yield of DAO or complete DAO of 90%). The most polar structures of the feedstock are concentrated in the fraction of asphalt.

The complete DAO originating from the first stage of deasphalting is then separated from the solvent according to the invention before being subjected to the second stage of extraction. All of the fraction of complete deasphalted oil, referred to as complete DAO, is sent to the second stage of extraction, which is carried out with the same solvents as in the first stage, propane (nC3) and toluene, but in different proportions. The operation is carried out with a mixture of solvent nC3/toluene (99.5/0.5; v/v), at a temperature of 120° C. and with a solvent/complete DAO ratio of 5/1 (v/m). A fraction of heavy DAO and a fraction of light DAO are obtained with yields of 54% and 36% respectively (yields calculated relative to the initial VR feedstock). All of the results are given in Table 4.

TABLE 4

Yield and properties of the fractions originating from the selective two-stage deasphalting according to the invention.

| | | Initial | 1$^{St}$ stage | | 2$^{nd}$ stage | |
|---|---|---|---|---|---|---|
| | | | | | Heavy DAO | Light DAO |
| | | Athabasca residue 480° C.+ | Asphalt nC3/toluene (35/65; v/v) | DAO nC3/toluene (35/65, v/v) | nC3/toluene (99.5/0.5; v/v) | nC3/toluene (99.5/0.5; v/v) |
| Extraction Yield (% feedstock) | | 100 | 10 | 90 | 54 | 36 |
| Analyses | | | | | | |
| d4, 15 | — | 1.044 | na | 1.029 | 1.064 | 0.976 |
| Sulphur | % m/m | 5.72 | 9.32 | 5.32 | 6.49 | 3.56 |
| Nitrogen | ppm | 6200 | 8900 | 5900 | 8431 | 2103 |
| Ni | ppm | 115 | 511 | 71 | 116 | 3 |
| V | ppm | 317 | 1460 | 190 | 313 | 6 |
| CCR | % m/m | 20.5 | >50 | 16.3 | 25.4 | 2.6 |

*na: not analysable.

The fraction of heavy deasphalted oil, referred to as heavy DAO, obtained according to the invention is enriched with the least polar resins and asphaltenes. This fraction has a pronounced aromatic nature and concentrates the impurities (metals, heteroatoms) more than the fraction of light deasphalted oil, referred to as light DAO. If the properties of this fraction are compared with those of the fraction of heavy DAO of Example 1, it is noted that they are more enriched with structures that are heavy but can be upcycled, contrary to Example 1 where these structures remain non-upcycled as they are contained in the fraction of asphalt. The yield of the fraction of heavy DAO produced that can be upcycled is clearly improved (54% as against 41% in the case of the conventional deasphalting of Example 1).

The whole of the fraction of heavy DAO is then sent to the RDS hydrotreatment unit under the operating conditions described in Table 5.

TABLE 5

Operating conditions of the start of the cycle of the RDS unit

| | |
|---|---|
| Catalyst | HF 858 - HT 438 |
| Temperature (° C.) | 370 |
| Pressure (MPa) | 15 |
| HSV (h−1) | 0.4 |
| Volumetric distribution of HDM/HDS catalyst (%) | 95/5 |
| H2/feedstock (Nm3/m3 feedstock) | 1000 |

The catalysts marketed by the company Axens under the following commercial references are used: HF 858 and HT 438:

HF 858: catalyst mainly active in HDM;

HT 438: catalyst mainly active in HDS.

TABLE 6

Characteristics of the cuts originating from the RDS unit

| Products | Yield (% by weight) | S (% by weight) | Viscosity 100° C. (Cst) | CCR (% by weight) | Ni + V (ppm) |
|---|---|---|---|---|---|
| $NH_3$ | 0.5 | 0 | — | — | — |
| $H_2S$ | 6 | 94.14 | — | — | — |
| C1-C4 | 0.6 | 0 | — | — | — |
| Gasoline (PI-150) | 0.7 | 0.012 | — | — | — |
| Gas oil (150-375) | 11 | 0.026 | — | — | — |
| VGO (375-520) | 35 | 0.17 | 10 | 0 | |
| VR (520+) | 48 | 1.00 | 205 | 12 | 20 |

with hydrogen consumed representing 1.80% by weight of the feedstock.

The whole of the fraction of light deasphalted oil, referred to as light DAO, as well as the whole of the VGO (375-520) and 36% of the VR (520+) originating from the RDS unit can be sent to an RFCC unit carried out under the same operating conditions as for Example 1. In the end, relative to this feedstock, a yield of gasoline of 49% by weight and of LPG (liquefied petroleum gas) laden with propylene of 17% by weight is obtained. In other words, relative to the initial input VR, a yield of gasoline of 23% by weight and of LPG (liquefied petroleum gas) laden with propylene of 8% by weight is obtained. A better separation of the initial input VR flow, thanks to the introduction of the two-stage selective SDA, between the part sent directly to the RFCC and the part sent to the RFCC after hydrotreatment therefore makes possible a net gain of 2 points in terms of the yield of gasoline and of 1 point in terms of the yield of LPG (liquefied petroleum gas) laden with propylene. These gasoline and LPG cuts are two products of high added value.

Another advantage compared with Example 1 is that the flow which is sent to the RDS unit comprises only the part of the feedstock which needs to be hydrotreated before being sent to the RFCC unit.

The invention claimed is:

1. A process for refining a heavy hydrocarbon feedstock, comprising a) at least two stages of deasphalting in series carried out on said feedstock to separate at least one fraction of asphalt, at least one fraction of heavy deasphalted oil, referred to as heavy DAO, and at least one fraction of light deasphalted oil, referred to as light DAO, at least one of said stages of deasphalting being carried out by a mixture of at least one polar solvent and at least one apolar solvent, the proportions of said polar solvent and said apolar solvent in the mixture of solvents being adjusted according to the properties of treated feedstock and according to predetermined asphalt yield and/or predetermined quality of deasphalted oil, said stages of deasphalting being implemented under subcritical conditions of the mixture of solvents, b) a stage of hydrotreatment of at least a part of the fraction of heavy deasphalted oil, referred to as heavy DAO, in the presence of hydrogen in at least one fixed-bed reactor containing at least one hydrodemetallization catalyst under conditions to obtain an effluent containing a reduced content of metals and Conradson carbon, c) a stage of catalytic cracking of at least a part of the fraction of light deasphalted oil, referred to as light DAO, alone or in a mixture with at least a part of the effluent originating from stage b), in at least one fluidized-bed reactor under conditions to produce a gaseous fraction, a gasoline fraction, an LCO fraction, an HCO fraction and slurry.

2. The process according to claim 1, comprising at least:

a1) a first stage of deasphalting comprising bringing the feedstock into contact with a mixture of at least one polar solvent and at least one apolar solvent, the proportions of said polar solvent and said apolar solvent being adjusted so as to obtain at least one fraction of asphalt and one fraction of complete deasphalted oil, referred to as complete DAO; and a2) a second stage of deasphalting comprising bringing at least a part of the fraction of complete deasphalted oil, referred to as complete DAO, originating from stage a1) into contact with either an apolar solvent or a mixture of at least one polar solvent and at least one apolar solvent, the proportions of said polar solvent and said apolar solvent in the mixture being adjusted so as to obtain at least one fraction of light deasphalted oil, referred to as light DAO, and one fraction of heavy deasphalted oil, referred to as heavy DAO, said stages of deasphalting being implemented under subcritical conditions of the apolar solvent or of the mixture of solvents.

3. The process according to claim 2, in which the fraction of complete deasphalted oil originating from stage a1) extracted at least in part with the mixture of solvents is subjected to at least one stage of separation in which the fraction of complete deasphalted oil, referred to as complete DAO, is separated from the mixture of solvents or at least one stage of separation in which the fraction of complete deasphalted oil, referred to as complete DAO, is separated only from the apolar solvent.

4. The process according to claim 2, in which the fraction of complete deasphalted oil, referred to as complete DAO, originating from stage a1) extracted at least in part with the mixture of solvents is subjected to at least two stages of separation in which the polar and apolar solvents are separated individually in each stage.

5. The process according claim 3, in which the fraction of complete deasphalted oil separated from the solvents is sent into at least one stripping column before being sent to the second stage of deasphalting.

6. The process according to claim 1 comprising at least:

a'1) a first stage of deasphalting comprising bringing the feedstock into contact with either an apolar solvent or a mixture of at least one polar solvent and at least one apolar solvent, the proportions of said polar solvent and said apolar solvent in the mixture being adjusted so as to obtain at least one fraction of light deasphalted oil, referred to as light DAO, and an effluent comprising an oil phase and an asphalt phase; and a'2) a second stage of deasphalting comprising bringing at least a part of the effluent originating from stage a'1) into contact with a mixture of at least one polar solvent and at least one apolar solvent, the proportions of said polar solvent and said apolar solvent being adjusted so as to obtain at least one fraction of asphalt and a fraction of heavy deasphalted oil, referred to as heavy DAO, said stages of deasphalting being implemented under subcritical conditions of the apolar solvent or the mixture of solvents.

7. The process according to claim 6, in which the effluent originating from stage a'1) is subjected to at least one stage of separation in which it is separated from the apolar solvent or the mixture of solvents or at least one stage of separation in which said effluent is separated only from the apolar solvent contained in the mixture of solvents.

8. The process according to claim 6, in which the effluent originating from stage a'1) is subjected to at least two successive stages of separation to separate the solvents individually in each stage of separation.

9. The process according to claim 7, in which the effluent separated from the solvents is sent into at least one stripping column before being sent to the second stage of deasphalting.

10. The process according to claim 1, in which the proportion of polar solvent in the mixture of polar solvent and apolar solvent in at least one of the stages of deasphalting is between 0.1 and 99.9%.

11. The process according to claim 1, in which the polar solvent is selected from the group consisting of pure aromatic solvents, naphthene-aromatic solvents, and polar solvents comprising heteroelements, or is a mixture thereof or is cuts rich in aromatics.

12. The process according to claim 1, in which the apolar solvent contains a saturated hydrocarbon having a number of carbon atoms greater than or equal to 2.

13. The process according to claim 1, in which the feedstock is selected from the group consisting of feedstocks of petroleum origin of the crude petroleum type, atmospheric residue, vacuum residue type originating from crude, a residual fraction originating from a pre-treatment process, a residual fraction originating from a conversion process, a residual fraction originating from direct liquefaction of lignocellulosic biomass alone, a residual fraction originating from direct liquefaction of lignocellulosic biomass in a mixture with coal and a fraction of residual petroleum.

14. The process according to claim 3, in which the separated mixture of polar and apolar solvent is recycled to the stage of extraction, the quantities and the proportion of polar and apolar solvent being verified and readjusted from a makeup tank.

15. The process according to claim 3, in which the individually separated polar and apolar solvents are recycled into their respective makeup tanks placed upstream of the stage of extraction in order to constitute the mixture of polar and apolar solvents in the proportions implemented in the stage of extraction.

16. The process according to claim 1, in which the products obtained during stage b) are subjected to a stage of separation, from which the following are recovered:

a gaseous fraction;

a gasoil cut having a boiling point between 150 and 375° C.;

a gasoline cut having a boiling point between 20 and 150° C.;

a vacuum distillate (vacuum gas oil or VGO) cut;

a vacuum residue (VR) cut.

17. The process according to claim 1, in which the polar solvent is a cut rich in aromatics and originates from FCC (fluid catalytic cracking) or originates from a petrochemical unit of a refinery, a cut derived from coal, biomass or a biomass/coal mixture.

18. The process according to claim 1, in which the apolar solvent contains a saturated hydrocarbon having a number of carbon atoms between 2 and 9.

19. The process according to claim 1, in which the feedstock is a residual fraction originating from a conversion process selected from the group consisting of hydrocracking, hydrotreatment, thermal cracking, hydroconversion of a crude petroleum type, an atmospheric residue and a vacuum residue type originating from crude.

20. The process according to claim 1, in which the proportion of polar solvent in the mixture of polar solvent and apolar solvent in at least one of the stages of deasphalting is between 35% and 80%.

* * * * *